US009709052B1

(12) United States Patent
Tanju et al.

(10) Patent No.: US 9,709,052 B1
(45) Date of Patent: Jul. 18, 2017

(54) SUBSEA FLUID PRESSURE REGULATION SYSTEMS AND METHODS

(71) Applicant: Chevron U.S.A. Inc., San Ramon, CA (US)

(72) Inventors: Baha T. Tanju, Katy, TX (US); Lee Mitchell, Katy, TX (US); Scott Weatherwax, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/377,193

(22) Filed: Dec. 13, 2016

(51) Int. Cl.

| | |
|---|---|
| ***F04B 49/08*** | (2006.01) |
| ***F04B 49/20*** | (2006.01) |
| ***F04B 49/24*** | (2006.01) |
| *E21B 41/00* | (2006.01) |

(52) U.S. Cl.
CPC ..... *F04B 49/08* (2013.01); *F04B 49/20* (2013.01); *F04B 49/24* (2013.01); *E21B 41/0007* (2013.01); *F15B 2211/505* (2013.01); *F15B 2211/857* (2013.01)

(58) Field of Classification Search
CPC ..... F04B 49/08; F04B 49/20; F04B 49/24; E21B 41/0007; F15B 2211/505; F15B 2211/857
See application file for complete search history.

(56) References Cited

U.S. PATENT DOCUMENTS

| | | | | |
|---|---|---|---|---|
| 5,238,070 | A * | 8/1993 | Schultz | E21B 23/04 166/319 |
| 6,298,767 | B1 * | 10/2001 | Porter | E21B 33/0355 166/344 |
| 7,793,725 | B2 * | 9/2010 | Daniel | B63B 21/508 166/345 |
| 8,955,595 | B2 * | 2/2015 | Emecheta | E21B 33/0355 166/338 |
| 9,080,407 | B2 * | 7/2015 | Bernard | E21B 21/08 |
| 2005/0178560 | A1 * | 8/2005 | Johansen | E21B 23/04 166/374 |

(Continued)

FOREIGN PATENT DOCUMENTS

| | | | |
|---|---|---|---|
| EP | 2156016 | B1 | 8/2011 |
| WO | 02/103211 | A1 | 12/2002 |

(Continued)

*Primary Examiner* — Benjamin Fiorello
(74) *Attorney, Agent, or Firm* — Karen R. DiDomenicis

(57) ABSTRACT

Systems and methods quickly regulate hydraulic fluid pressure to meet hydraulic fluid demands in subsea equipment over long umbilicals. A hydraulic power unit includes a reservoir and a pump for pumping hydraulic fluid from the reservoir into a fluid supply line to subsea equipment. A supply-side module located downstream of the hydraulic power unit includes a circulation pump in communication with the supply line for circulating hydraulic fluid in a circuit including the fluid supply line and a fluid return line. A demand-side module is located upstream of the subsea equipment and includes a diverter valve for opening or closing the circuit. Adjustments can be made to the circulation pump and the diverter valve such that hydraulic fluid is circulated through the circuit. The pressure of the supply-side module is greater and does not exceed twice than the pressure of the demand-side module.

28 Claims, 3 Drawing Sheets

(56) References Cited

U.S. PATENT DOCUMENTS

| | | | | |
|---|---|---|---|---|
| 2006/0231265 | A1* | 10/2006 | Martin | B63C 11/52<br>166/365 |
| 2008/0296025 | A1 | 12/2008 | Inderberg et al. | |
| 2013/0136634 | A1* | 5/2013 | Sæle | F04C 11/008<br>417/423.3 |

FOREIGN PATENT DOCUMENTS

| | | | |
|---|---|---|---|
| WO | 2011/062751 | A2 | 5/2011 |
| WO | 2014/132079 | A2 | 9/2014 |

* cited by examiner

SUBSEA FLUID PRESSURE REGULATION SYSTEMS AND METHODS

FIELD

The present disclosure relates to systems and methods for regulating, by increasing or decreasing, pressure of hydraulic fluid supplied to subsea equipment.

BACKGROUND

In conventional offshore oil and gas production systems, subsea equipment is operated using hydraulic fluid provided via lines commonly referred to as umbilicals. A standard subsea hydraulic fluid power delivery system relies on hydraulic fluid in umbilicals and subsea accumulators in which hydraulic energy is accumulated. Fluid is mobilized within the system in response to demands at the subsea equipment. The mobilization of fluid in the umbilical refers to the flowrate at which fluid can be delivered through the umbilical over a distance in response to a demand. This is dependent on the umbilical geometry, including, but not limited to, length, inner diameter, the speed of sound in fluid and the pressure difference between the surface and the subsea equipment location. As a result, an undesirable delay or lag in response time often occurs when the umbilical is quite long. Compression of nitrogen is used to store hydraulic energy in the form of fluid under pressure so that the fluid in the accumulator can meet system demands until fluid in the umbilical can be mobilized. However, the efficiency of nitrogen for compression deteriorates rapidly with increasing absolute pressures in deep water. In certain cases, stored hydraulic energy at a subsea location adversely can delay lowering of the subsea hydraulic pressure.

There exists a need for a subsea hydraulic fluid pressure regulation system which can meet or respond to hydraulic fluid demands by increasing or decreasing hydraulic fluid pressure in a subsea location more quickly.

SUMMARY

In one aspect, provided is a subsea hydraulic fluid pressure regulation system useful for increasing the hydraulic fluid pressure at a subsea location. The system includes a hydraulic power unit for supplying hydraulic fluid, the hydraulic power unit including at least a hydraulic fluid reservoir and a hydraulic power unit pump for pumping hydraulic fluid from the hydraulic fluid reservoir into a fluid supply line for transporting hydraulic fluid from the hydraulic power unit to subsea equipment. The fluid supply line is connected to the subsea equipment. A fluid return line is provided for transporting hydraulic fluid from a subsea location in the fluid supply line upstream of the subsea equipment to the hydraulic fluid reservoir.

The system also includes a supply-side module located downstream of the hydraulic power unit which includes a circulation pump in fluid communication with the fluid return line and the fluid supply line for receiving hydraulic fluid from the fluid return line and pumping hydraulic fluid into the fluid supply line. A line connects the fluid return line with the circulation pump. A line connects the circulation pump with the fluid supply line. A check valve is provided in the line connecting the circulation pump with the fluid supply line and downstream of the circulation pump for preventing backflow of hydraulic fluid into the circulation pump. A pressure transducer is provided in the fluid supply line downstream of the circulation pump for monitoring pressure of the hydraulic fluid.

The system also includes a demand-side module located upstream of the subsea equipment which includes a connection line connecting the fluid supply line with the fluid return line. A diverter valve is provided in the connection line for controlling fluid communication between the fluid supply line and the fluid return line thereby opening or closing a circuit that includes the fluid supply line and the fluid return line. A pressure transducer is provided in the fluid supply line for monitoring pressure of the hydraulic fluid located downstream of an intersection of the fluid supply line and the connection line.

Adjustments can be made to the circulation pump and the diverter valve such that hydraulic fluid is circulated through the circuit that includes the fluid supply line and the fluid return line, such that the pressure monitored by the pressure transducer of the supply-side module is greater than the pressure monitored by the pressure transducer of the demand-side module and does not exceed twice the pressure monitored by the pressure transducer of the demand-side module.

In another aspect, provided is a method for increasing subsea supply pressure using the system described above. With the fluid supply line connected to the subsea equipment, the circulation pump is started at an initial pump speed. After the pressure monitored by the pressure transducer of the demand-side module exceeds a predetermined pressure, the diverter valve is opened such that hydraulic fluid is circulated through the circuit that includes the fluid supply line and the fluid return line. The pump speed of the circulation pump is then increased until the pressure monitored by the pressure transducer of the demand-side module reaches a predetermined pressure wherein the pressure monitored by the pressure transducer of the supply-side module is greater than the pressure monitored by the pressure transducer of the demand-side module and does not exceed twice the pressure monitored by the pressure transducer of the demand-side module.

In another aspect, provided is a subsea hydraulic fluid pressure regulation system useful for decreasing the hydraulic fluid pressure at a subsea location. The system includes a hydraulic power unit as described above. A fluid return line is provided that is adapted to be connected to subsea equipment for transporting hydraulic fluid from the subsea equipment to the hydraulic fluid reservoir of the hydraulic power unit. A fluid supply line is provided for transporting hydraulic fluid from the hydraulic power unit to a location in the fluid return line upstream of the subsea equipment. The system includes a supply-side module as described above located downstream of the hydraulic power unit and a demand-side module as described above located upstream of the subsea equipment. Adjustments can be made to the circulation pump and the diverter valve such that hydraulic fluid is circulated through the circuit that includes the fluid supply line and the fluid return line, such that the pressure monitored by the pressure transducer of the supply-side module is greater than the pressure monitored by the pressure transducer of the demand-side module and does not exceed twice the pressure monitored by the pressure transducer of the demand-side module.

In another aspect, provided is a method for decreasing subsea supply pressure using the system described above. With the fluid supply line connected to the subsea equipment, the circulation pump is started at an initial pump speed. After the pressure monitored by the pressure transducer of the demand-side module exceeds a predetermined pressure, the diverter valve is opened such that hydraulic fluid is circulated through the circuit that includes the fluid supply line and the fluid return line. The pump speed of the circulation pump is then increased until the pressure monitored by the pressure transducer of the demand-side module reaches a predetermined pressure wherein the pressure monitored by the pressure transducer of the supply-side module is greater than the pressure monitored by the pressure transducer of the demand-side module and does not exceed twice the pressure monitored by the pressure transducer of the demand-side module.

DESCRIPTION OF THE DRAWINGS

These and other objects, features and advantages of the present invention will become better understood with reference to the following description, appended claims and accompanying drawings. The drawings are not considered limiting of the scope of the appended claims. The elements shown in the drawings are not necessarily to scale. Reference numerals designate like or corresponding, but not necessarily identical, elements.

DETAILED DESCRIPTION

Figure 1:
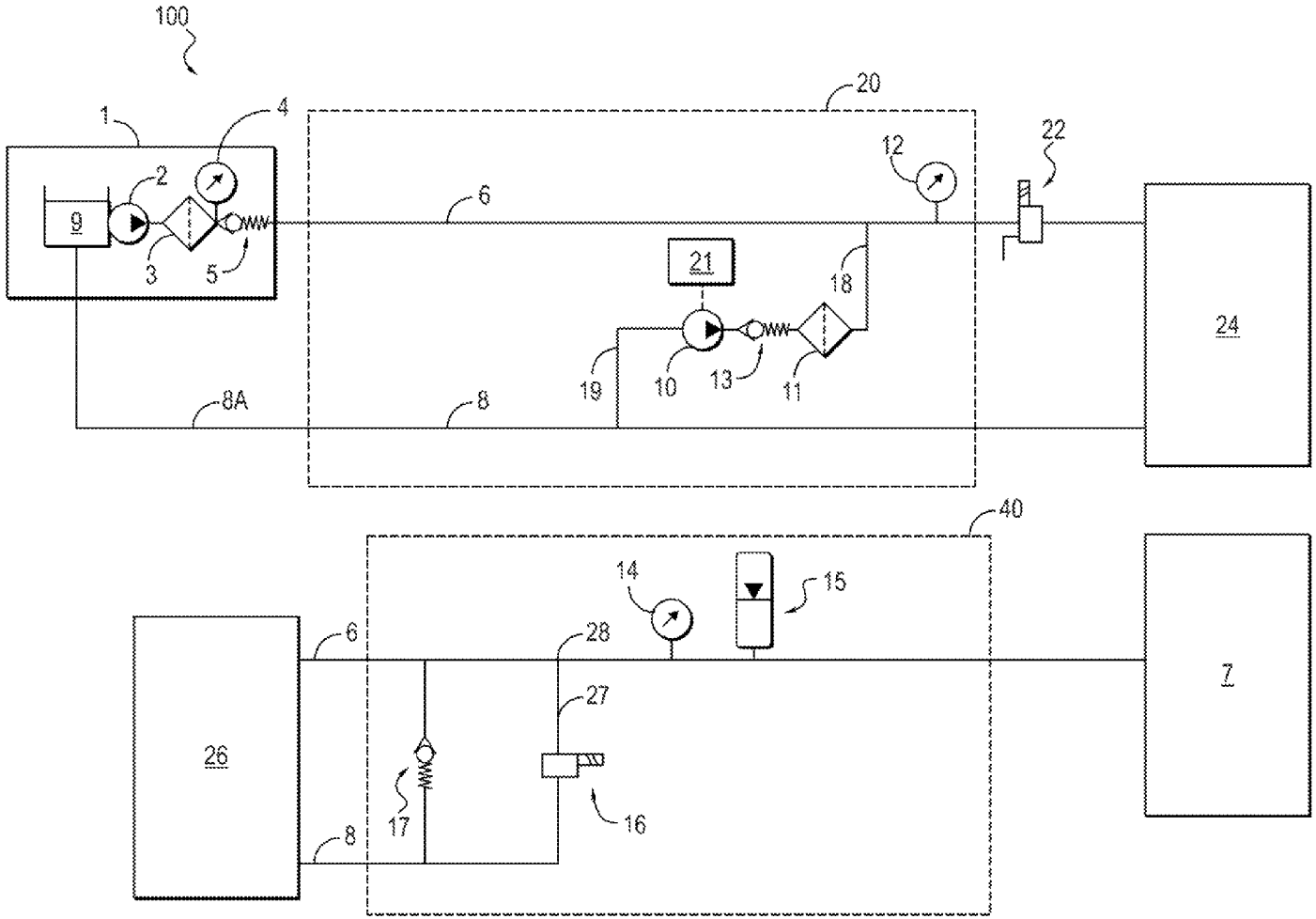
FIG. 1 is a schematic diagram illustrating a hydraulic fluid pressure regulation system according to one exemplary embodiment.

Embodiments of a subsea hydraulic fluid delivery system will be described herein under with reference to the appended drawings. As shown in FIG. 1, a subsea hydraulic fluid delivery system 100 includes a hydraulic power unit (HPU) 1 for supplying hydraulic fluid, the HPU 1 including a hydraulic fluid reservoir 9 open to the atmosphere and a hydraulic power unit pump 2 for pumping hydraulic fluid from the hydraulic fluid reservoir 9 into a fluid supply line 6. The HPU 1 can also include an optional filter 3 for filtering particulate matter out of the hydraulic fluid, an optional pressure transducer 4 for monitoring the pressure of the fluid in the HPU 1, and an optional check valve 5 for preventing backflow.

The fluid supply line 6 is used for transporting hydraulic fluid from the hydraulic power unit 1 to subsea equipment 7 located at a subsea location. By "line" is meant any conduit providing fluid communication, and is not necessarily continuous. The system 100 also includes a fluid return line 8 for transporting hydraulic fluid from a subsea location in the fluid supply line 6 upstream of the subsea equipment 7 to the hydraulic fluid reservoir 9. The fluid return line 8 can have a length approximately equal to the length of the fluid supply line 6.

In one embodiment, the system 100 includes a supply-side module 20 located in relatively close proximity, e.g., within 200 ft or so downstream of the hydraulic power unit 1. The supply-side module 20 is connected between the fluid supply line 6 and the fluid return line 8. The supply-side module 20 enhances momentum of hydraulic fluid in the fluid supply line 6 at subsea locations in relatively close proximity, e.g., within 200 ft or so, to the subsea equipment 7. The supply-side module 20 includes a circulation pump 10 in fluid communication with the fluid return line 8 and the fluid supply line 6 for receiving hydraulic fluid from the fluid return line 8 and pumping hydraulic fluid into the fluid supply line 6. A line 19 connects the fluid return line 8 with the circulation pump 10. A line 18 connects the circulation pump 10 with the fluid supply line 6. A check valve 13 in the line 18 connecting the circulation pump 10 with the fluid supply line 6 downstream of the circulation pump 10 can prevent backflow of hydraulic fluid into the circulation pump 10. A pressure transducer 12 in the fluid supply line 6 downstream of the circulation pump 10 is provided for monitoring pressure of the hydraulic fluid in line 6. In one embodiment, the supply-side module 20 includes an optional filter 11 located between the check valve 13 and the fluid supply line 6 for removing particulate matter from the hydraulic fluid. The filter 11 greatly increases the cleanliness of the hydraulic fluid as it is circulated.

Supply-side module 20 is shown in FIG. 1 within a dotted line to indicate that supply-side module 20 includes the system components therein. The system components within supply-side module 20 may or may not be housed within a common enclosure.

In one embodiment, the system 100 includes a demand-side module 40 located in relatively close proximity, e.g., within 200 ft or so upstream of, the subsea equipment 7. A Demand-side module 40 is connected between the fluid supply line 6 and the fluid return line 8. In one embodiment, the demand-side module 40 includes a connection line 27 connecting the fluid supply line 6 with the fluid return line 8, intersecting the fluid return line 8 at the point of intersection designated 28. A pressure transducer 14 is provided in the fluid supply line 6 for monitoring pressure of the hydraulic fluid located downstream of the point of intersection 28. A diverter valve 16 is provided in the connection line 27 for controlling fluid communication between the fluid supply line 6 and the fluid return line 8, thereby opening or closing a circuit created by the fluid supply line 6 and the fluid return line 8. The diverter valve 16 can be a either a solenoid valve or a pilot operated valve. In one embodiment, the diverter valve 16 can be a normally closed type valve. This valve can be piloted from line 6 such that when pressure in line 6 drops to a value (e.g., 3500 psig), the pilot operated valve 16 will close, and reopen when pressure line 6 increases. In the event of the diverter valve 16 failure, the failure will be detected by pressure transducer 14, the pump 10 will be stopped and pressure on line 6 will be vented by directional control valve 22. A pressure relief valve 17 can be used to prevent overpressure in the fluid supply line 6 in the event of pressure buildup in which diverter valve 16 fails to open, by opening and venting access from line 6 to line 8. In one embodiment, the demand-side module 40 includes a pressure dampening accumulator 15 useful for dampening sudden pressure increases and decreases (i.e., "pressure transients") caused by opening and closing of the diverter valve 16.

If the pressure at the subsea equipment 7 drops below tolerable levels, the diverter valve 16 will close to increase the pressure for the subsea equipment 7, while pressure at the subsea end of the supply line 6 increases and the pressure at the subsea end of the return line 8 decreases due to the momentum of the flowing fluid. The relief valve 17 cracking pressure (i.e., the differential pressure between the supply line 6 and the return line 8) is set such that the relief valve 17 opens before the fluid in the return line 8 reaches the vapor pressure at subsea ambient temperature.

In one embodiment, the diverter valve 16 is controlled by a control system using the pressure as monitored by the pressure transducer 14 of the demand-side module 40 as input to achieve and maintain a predetermined pressure as monitored by the pressure transducer 14. If the pressure as monitored by the transducer 14 drops lower than the predetermined pressure, then the diverter valve 16 will close.

Demand-side module 40 is shown in FIG. 1 within a dotted line to indicate that demand-side module 40 includes the system components therein. As with supply-side module 20, the system components within demand-side module 40 may or may not be housed within a common enclosure. In one embodiment, the demand-side module 40 is retrievable. For instance, in some instances, it is desirable to retrieve the demand-side module 40 at a subsea distribution unit (SDU) (not shown).

Between the circuit (made up of the supply line 6 and the return line 8) and the reservoir 9 of the HPU 1 is a segment of the return line designated 8A. Hydraulic fluid may freely flow in either direction in segment 8A. Because of this and because the reservoir 9 of the HPU 1 is open to the atmosphere, segment 8A acts as a fluid pressure buffer in both directions.

Adjustments can be made to the circulation pump 10, also referred to herein as the pump 10, and/or the diverter valve 16 such that hydraulic fluid is circulated through the circuit made up of the fluid supply line 6 and the fluid return line 8, and such that the pressure as monitored by the pressure transducer 12 of the supply-side module 20 is greater than the pressure monitored by the pressure transducer 14 of the demand-side module 40 and does not exceed twice the pressure monitored by the pressure transducer 14 of the demand-side module 40. The average pressure of fluid in the supply line 6 and return line 8 is the pressure monitored by the pressure transducer 14. During circulation of fluid when fluid flow is stabilized, the pressure in the supply line 6 is always less than or equal to twice the pressure monitored by the pressure transducer 14 since the return line 8 is connected to the reservoir 9 which is preferably open to the atmosphere, and since the length of the supply and return lines are approximately equal.

In one embodiment, the system 100 includes a topside umbilical termination assembly (TUTA) 24 located downstream of the supply-side module 20 and in fluid communication with the fluid return line 8 and the fluid supply line 6 for terminating one or more umbilical(s) at a topside location. The fluid return line 8 and the fluid supply line 6 themselves can be included within umbilicals which terminate at TUTA 24. Similarly, the system 100 can also include a subsea umbilical termination assembly (SUTA) 26 located upstream of the demand-side module 40 and in fluid communication with the fluid return line 8 and the fluid supply line 6 for terminating one or more umbilical(s) at a subsea location.

The system 100 can be used to increase subsea supply pressure at the location of subsea equipment 7 by utilizing the momentum of the hydraulic fluid in the circuit. The circulation pump 10 drives hydraulic fluid through the circuit made up of the supply line 6 and the return line 8 (also referred to herein as the "circuit"). Hydraulic fluid is caused to continuously circulate through the circuit. In one embodiment, the speed of the pump 10 is controlled by a variable frequency drive 21 which varies the speed of a motor that drives the circulation pump 10. In one embodiment, the variable frequency drive 21 operates according to a ramp-up curve, as would be apparent to one of ordinary skill in the art. In one embodiment, the circulation pump 10 is controlled by a control system using the pressure as monitored by the pressure transducer 12 of the supply-side module 20 and the pressure as monitored by the pressure transducer 14 of the demand-side module 40 as inputs to achieve and maintain a predetermined pressure as monitored by the pressure transducer 14 of the demand-side module 40.

In one embodiment, the circulation pump 10 is started at an initial pump speed and the pressure is monitored by the pressure transducer 14 of the demand-side module 40. When the pressure monitored by the pressure transducer 14 exceeds a predetermined pressure, the normally closed diverter valve 16 is opened thus circulating hydraulic fluid through the circuit. The pump speed is then increased until the pressure monitored by the pressure transducer 12 of the supply-side module 20 reaches a desired pressure which is up to about twice the pressure as monitored by the pressure transducer 14 of the demand-side module 40. The diverter valve 16 can be periodically opened and closed over time as controlled by the pressure monitored by pressure transducer 14.

After a stabilization period the length of which depends on the physical values of the fluid, length of the lines in the circuit, the speed of sound in the fluid, tubing geometry, friction and fluid viscosity, and the like, the average pressure of the supply-side module 20, supply line 6 and return line 8 becomes equivalent to the pressure as monitored by the pressure transducer 14 of the demand-side module 40. The pressure of supply side supply line 6 will be less than or equal to twice the pressure monitored by the pressure transducer 14 of the demand-side module 40.

In one embodiment, a total of the pressure as monitored by the pressure transducer 12 of the supply-side module 20 plus a pressure in the circuit equals from 1000 psia to 20 kpsig. The fluid moves continuously in the umbilical of the circuit. Thus, there is no time required to mobilize the fluid where it is needed at a subsea location. This drastically improves the hydraulic response time for especially long umbilicals. In one embodiment, the pressure as monitored by the pressure transducer 14 can be increased very quickly using the system 100, e.g., as if the pressure transducer 14 were located topside within 200 ft of the HPU 1.

By closing the diverter valve 16, the moving fluid in the umbilical supply line 6 can be diverted to the optional subsea accumulators 15. The resulting fluid transient can be used to rapidly charge the subsea accumulators 15. Therefore subsea pressure can be rapidly regulated on demand.

In one embodiment, the pressure as monitored by the pressure transducer 12 of the supply-side module 20 can range from 0 psig up to twice the desired subsea pressure, not to exceed twice the subsea pressure.

In one embodiment, the subsea equipment 7 can be located at least 5 km, and even 50 km, and even 100 km, from the hydraulic power unit 1. Therefore, each of the fluid supply line 6 and fluid return line 8 are also at least 5 km long, and even 50 km long, and even 100 km long. In such cases, the systems disclosed herein are particularly advantageous since the momentum of the circulating hydraulic fluid in the circuit is available for increasing and/or decreasing the pressure at the subsea equipment 7.

Figure 2:
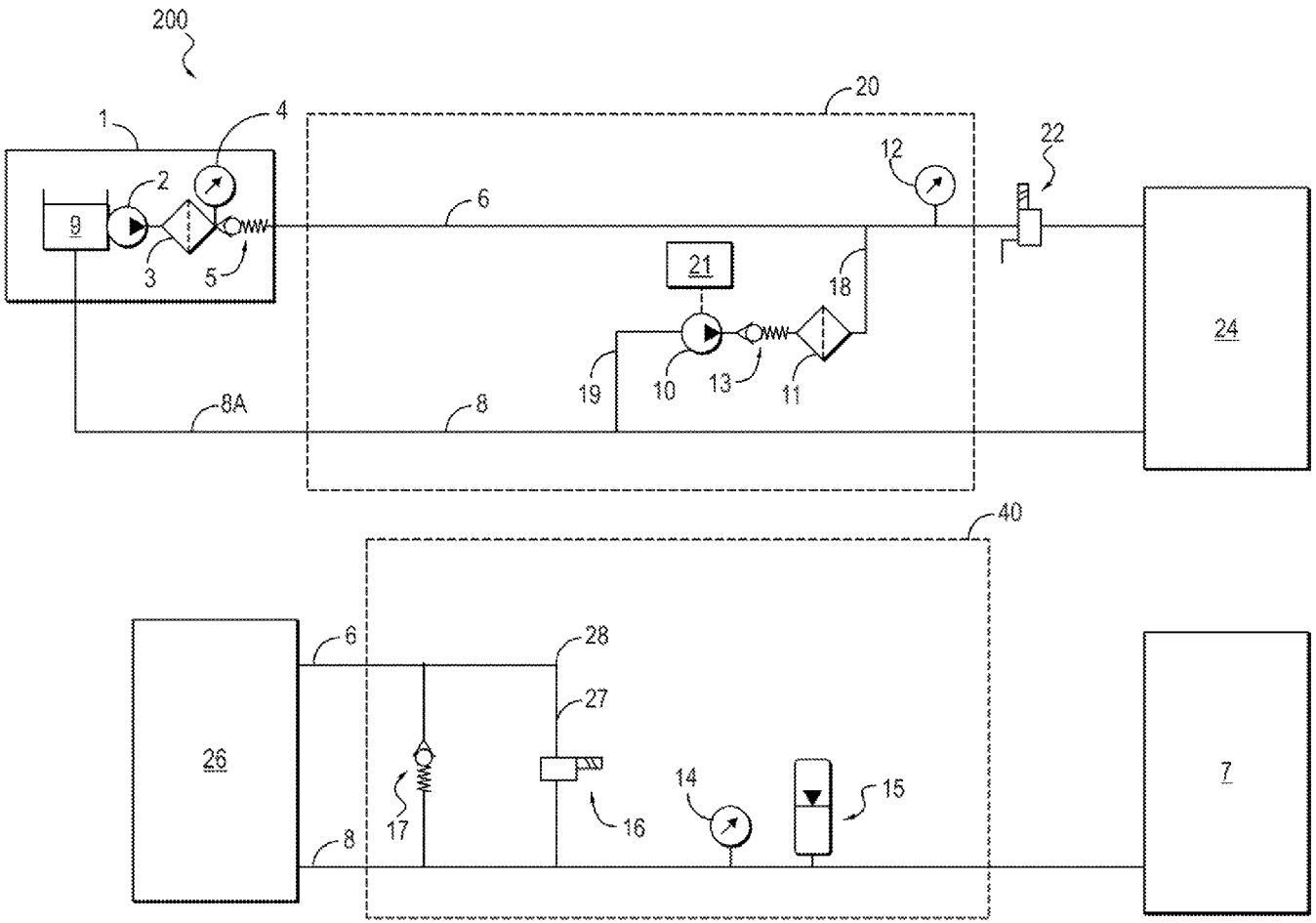
FIG. 2 is a schematic diagram illustrating a hydraulic fluid pressure regulation system according to another exemplary embodiment.

In another embodiment, shown in FIG. 2, a system 200 is provided to decrease subsea pressure at the location of subsea equipment 7. System 200 is similar to system 100, however the fluid return line 8 is connected to the subsea equipment 7 in this embodiment. Such a system can be used, for example, when the subsea equipment 7 is a mechanical seal of a subsea single phase pump where the mechanical seal is located between the pump (not shown) and a motor (not shown), and the pressure of barrier fluid used to isolate the mechanical seal is being controlled. Again, the system 200 decreases the subsea pressure at the location of the subsea equipment 7 by utilizing the momentum of the hydraulic fluid in the circuit.

By closing the diverter valve 16, the resulting fluid transient can be used to rapidly discharge the accumulators 15. Therefore subsea pressure can be rapidly regulated on demand.

Figure 3:
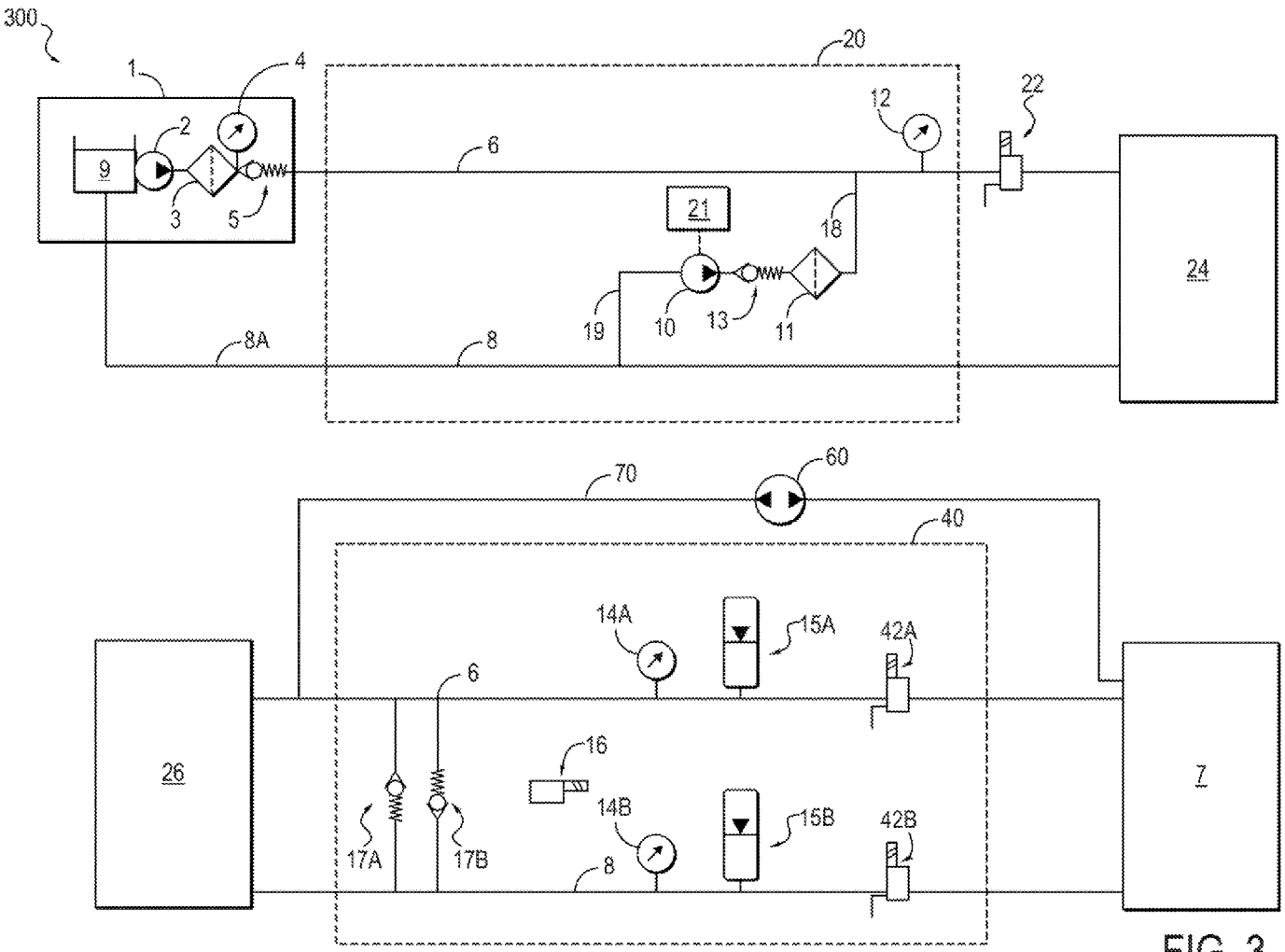
FIG. 3 is a schematic diagram illustrating a hydraulic fluid pressure regulation system according to yet another exemplary embodiment.

In another embodiment, as shown in FIG. 3, a system 300 is provided capable of increasing and/or decreasing subsea supply pressure utilizing momentum of hydraulic fluid in the circuit. System 300 is capable of providing redundant control; therefore system 300 provides enhanced reliability. System 300 is similar to system 100; however the fluid return line 8 and the fluid supply line 6 both terminate at the subsea equipment 7 in this embodiment. The fluid return line 8 and the fluid supply line 6 both terminate at the other end at hydraulic power units 1A and 1B. Solenoids 32A and 32B which act as isolation valves can be provided which can be configured to be closed during normal operation while fluid is circulating through the circuit. Solenoid 32A or 32B can be opened to increase the pressure in the circuit. Dump valves 34A and 34B can be provided which can be configured to be opened during normal operation while fluid is circulating through the circuit in order to remove fluid from the circuit and decrease the pressure. Pressure on line 6 can be vented by directional control valve 22A; likewise, pressure on line 8 can be vented by directional control valve 22B. Solenoids 36A, 36B, 38A and 38B can be opened and closed in various combinations to divert flow from line 6 through pump 10 to line 8 and vice versa.

In one embodiment, solenoids 42A and 42B which act as isolation valves are provided which can be configured to be closed during normal operation while fluid is circulating through diverter valve 16. Solenoid 42A or 42B can open to pull or push fluid into subsea equipment 7.

In one embodiment, an optional positive displacement pump 60, also referred to as a gear pump 60, is provided in a bypass line 70 passing between subsea umbilical termination assembly 26 and subsea equipment 7.

The gear pump design can be any type such that it does not allow fluid flow when not in operation. The gear pump 60 is capable of metering or transmitting fluid reversibly, i.e., in either direction therethrough. Thus, fluid can be transmitted from subsea umbilical termination assembly 26 towards subsea equipment 7 or from subsea equipment 7 towards subsea umbilical termination assembly 26 regardless of the pressure differential. One nonlimiting example of a suitable pump is disclosed in U.S. Pat. No. 8,955,595B2, the contents of which are incorporated by reference herein.

In one embodiment, the gear pump 60 can provide pressure/fluid regulation in conjunction with the supply-side module 20 and/or the demand-side module 40. For instance, solenoids A and B are closed during normal operation and fluid is pulled or pushed into subsea equipment 7 using the gear pump 60. Solenoids A and B can be opened/closed during high fluid flow demand. Gear pump 60 can be used to fine tune fluid flow requirements.

In one embodiment, the gear pump 60 can also provide pressure/fluid regulation in case the supply-side module 20 and/or the demand-side module 40 fail(s). For instance, in the event that equipment in the supply-side module 20 or the demand-side module 40 fails, solenoids A and B are then closed. The gear pump 60 can be used to pull/push fluid into subsea equipment 7.

In one embodiment, the gear pump 60 can be a replacement for optional accumulators such as 15A and 15B.

The systems and methods disclosed herein are useful for rapidly regulating subsea fluid pressure in systems including long umbilicals. Such systems are advantageous in oil and gas production facilities associated with production from low permeability reservoirs. Such systems are also advantageous for use in oil and gas production facilities that utilize deep water pumps and/or gas compressors, particularly where multiphase and single phase pumps are connected in series. System components including pumps and gas compressors are protected from production pressure transients.

The systems and methods disclosed herein can be useful for boosting barrier fluids to pressures required to maintain the integrity of barrier seals within subsea pumps. This would allow for variable barrier fluid pressures to be achieved locally at the pump with quick response times. For instance, subsea equipment 7 can be a motor coupled to a subsea pump (not shown). The pressure needs to be regulated to within 300 psi between the barrier fluid in the motor and the subsea pump (also referred to as the production pump). In a nonlimiting example, if the barrier pressure drops 300 psi below the pressure of the production fluid, then production fluid can leak into the motor damaging the motor. In a nonlimiting example, if the barrier pressure rises 300 psi above the pressure of the production fluid, then the mechanical seal between the motor and the production pump will be damaged, thus allowing production fluid to seep into the motor. Pressure sensors are associated with the subsea equipment 7 to help regulate the pressure to a precise value. If the pressure drops then fluid may need to be added, either by the gear pump 60 or by operating the supply-side module 20 and/or the demand-side module 40. If the pressure increases then fluid may need to be taken from the subsea equipment 7 using either the gear pump 60 or the supply-side module 20 and/or the demand-side module 40.

The systems disclosed herein provide an alternative to fast acting electric actuators in such applications by greatly improving pressure increase and/or decrease response time. The use of the systems disclosed allows the volume of subsea accumulators to be minimized or eliminated. Furthermore, in the case of long umbilicals, the systems disclosed herein can be used to rapidly depressurize subsea accumulators within the system, thus minimizing the risk of control fluid discharging into the surrounding environment during emergency shutdown.

It should be noted that only the components relevant to the disclosure are shown in the figures, and that many other components normally part of a hydraulic fluid supply system are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A subsea hydraulic fluid pressure regulation system, comprising:

a. a hydraulic power unit for supplying hydraulic fluid, the hydraulic power unit comprising a hydraulic fluid reservoir and a hydraulic power unit pump for pumping hydraulic fluid from the hydraulic fluid reservoir into a fluid supply line;

b. the fluid supply line for transporting hydraulic fluid from the hydraulic power unit to subsea equipment wherein the fluid supply line is adapted to be connected to the subsea equipment;

c. a fluid return line for transporting hydraulic fluid from a subsea location in the fluid supply line upstream of the subsea equipment to the hydraulic fluid reservoir;

d. a supply-side module located downstream of the hydraulic power unit, comprising:

i. a circulation pump in fluid communication with the fluid return line and the fluid supply line for receiving hydraulic fluid from the fluid return line and pumping hydraulic fluid into the fluid supply line;

ii. a line connecting the fluid return line with the circulation pump;

iii. a line connecting the circulation pump with the fluid supply line;

iv. a check valve in the line connecting the circulation pump with the fluid supply line and downstream of the circulation pump for preventing backflow of hydraulic fluid into the circulation pump; and v. a pressure transducer in the fluid supply line downstream of the circulation pump for monitoring pressure of the hydraulic fluid; and e. a demand-side module located upstream of the subsea equipment, comprising:

i. a connection line connecting the fluid supply line with the fluid return line, intersecting the fluid return line at a location;

ii. a diverter valve in the connection line for controlling fluid communication between the fluid supply line and the fluid return line thereby opening or closing a circuit comprising the fluid supply line and the fluid return line; and iii. a pressure transducer in the fluid supply line for monitoring pressure of the hydraulic fluid located downstream of a point of intersection of the fluid supply line and the connection line;

wherein adjustments can be made to the circulation pump and the diverter valve such that hydraulic fluid is circulated through the circuit comprising the fluid supply line and the fluid return line, and such that the pressure monitored by the pressure transducer of the supply-side module is greater than the pressure monitored by the pressure transducer of the demand-side module and does not exceed twice the pressure monitored by the pressure transducer of the demand-side module.

2. A subsea hydraulic fluid pressure regulation system, comprising:

a. a hydraulic power unit for supplying hydraulic fluid, the hydraulic power unit comprising a hydraulic fluid reservoir and a hydraulic power unit pump for pumping hydraulic fluid from the hydraulic fluid reservoir into a fluid supply line;

b. a fluid return line adapted to be connected to subsea equipment for transporting hydraulic fluid from the subsea equipment to the hydraulic fluid reservoir;

c. the fluid supply line for transporting hydraulic fluid from the hydraulic power unit to a location in the fluid return line and upstream of the subsea equipment;

d. a supply-side module located downstream of the hydraulic power unit, comprising:

i. a circulation pump in fluid communication with the fluid return line and the fluid supply line for receiving hydraulic fluid from the fluid return line and pumping hydraulic fluid into the fluid supply line;

ii. a line connecting the fluid return line with the circulation pump;

iii. a line connecting the circulation pump with the fluid supply line;

iv. a check valve in the line connecting the circulation pump with the fluid supply line and downstream of the circulation pump for preventing backflow of hydraulic fluid into the circulation pump; and v. a pressure transducer in the fluid supply line downstream of the circulation pump for monitoring pressure of the hydraulic fluid; and e. a demand-side module located upstream of the subsea equipment, comprising:

i. a connection line connecting the fluid supply line with the fluid return line, intersecting the fluid return line at a location;

ii. a diverter valve in the connection line for controlling fluid communication between the fluid supply line and the fluid return line thereby opening or closing a circuit comprising the fluid supply line and the fluid return line; and iii. a pressure transducer in the fluid return line for monitoring pressure of the hydraulic fluid located downstream of the location of intersection of the fluid return line and the connection line;

wherein adjustments can be made to the circulation pump and the diverter valve such that hydraulic fluid is circulated through the circuit comprising the fluid supply line and the fluid return line, and such that the pressure monitored by the pressure transducer of the supply-side module is greater than the pressure monitored by the pressure transducer of the demand-side module and does not exceed twice the pressure monitored by the pressure transducer of the demand-side module.

3. The subsea hydraulic fluid pressure regulation system of claim 1 or claim 2, wherein the hydraulic fluid reservoir is open to the atmosphere.

4. The subsea hydraulic fluid pressure regulation system of claim 1 or claim 2, wherein the fluid supply line has a fluid supply line length and the fluid return line has a fluid return line length approximately equal to the fluid supply line length.

5. The subsea hydraulic fluid pressure regulation system of claim 1 or claim 2, wherein the diverter valve in the demand-side module is configured to be normally closed.

6. The subsea hydraulic fluid pressure regulation system of claim 1 or claim 2, wherein the supply-side module further comprises a filter located between the check valve and the fluid supply line for removing particulate matter from the hydraulic fluid.

7. The subsea hydraulic fluid pressure regulation system of claim 1 or claim 2, further comprising a variable frequency drive for varying the speed of a motor for driving the circulation pump wherein the variable frequency drive operates the circulation pump to achieve desired flow rates or pressures.

8. The subsea hydraulic fluid pressure regulation system of claim 1, wherein the demand-side module further comprises a pressure relief valve for preventing overpressure in the fluid supply line in the event the diverter valve fails to open.

9. The subsea hydraulic fluid pressure regulation system of claim 1 or claim 2, wherein the diverter valve is controlled by a control system using the pressure monitored by the pressure transducer of the demand-side module as input to achieve and maintain a predetermined pressure as monitored by the pressure transducer of the demand-side module.

10. The subsea hydraulic fluid pressure regulation system of claim 1 or claim 2, wherein the circulation pump is controlled by a control system using the pressure monitored by the pressure transducer of the supply-side module and the pressure monitored by the pressure transducer of the demand-side module as inputs to achieve and maintain a predetermined pressure as monitored by the pressure transducer of the demand-side module.

11. The subsea hydraulic fluid pressure regulation system of claim 1 or claim 2, wherein the demand-side module further comprises a pressure dampening accumulator for dampening sudden pressure increases and decreases associated with opening and closing the diverter valve.

12. The subsea hydraulic fluid pressure regulation system of claim 1 or claim 2, further comprising a topside umbilical termination assembly downstream of the supply-side module and in fluid communication with the fluid return line and the fluid supply line for terminating an umbilical at a topside location.

13. The subsea hydraulic fluid pressure regulation system of claim 1 or claim 2, further comprising a subsea umbilical termination assembly upstream of the demand-side module and in fluid communication with the fluid return line and the fluid supply line for terminating an umbilical at a subsea location.

14. The subsea hydraulic fluid pressure regulation system of claim 1, further comprising a redundant line adapted to be connected to the subsea equipment and connecting the fluid return line to the subsea equipment downstream of the location that the connection line intersects the fluid return line.

15. The subsea hydraulic fluid pressure regulation system of claim 14, further comprising an isolate valve in the redundant line for controlling fluid communication between the fluid return line and the subsea equipment.

16. The subsea hydraulic fluid pressure regulation system of claim 14, further comprising a pressure transducer in the redundant line for monitoring pressure of the hydraulic fluid in the redundant line.

17. The subsea hydraulic fluid pressure regulation system of claim 1 or claim 2, wherein the subsea equipment is located at least 5 km from the hydraulic power unit; and wherein each of the fluid supply line and the fluid return line is at least 5 km long.

18. The subsea hydraulic fluid pressure regulation system of claim 1 or claim 2, wherein the subsea equipment is located at least 50 km from the hydraulic power unit; and wherein each of the fluid supply line and the fluid return line is at least 50 km long.

19. The subsea hydraulic fluid pressure regulation system of claim 1 or claim 2, wherein the subsea equipment is a subsea single phase pump and wherein the hydraulic fluid is a barrier fluid to isolate a seal of the subsea single phase pump.

20. The subsea hydraulic fluid pressure regulation system of claim 1 or claim 2, further comprising a positive displacement pump in a bypass line wherein the bypass line has a first end terminating between the subsea umbilical termination assembly and the demand-side module and a second end terminating at the subsea equipment.

21. A method for increasing or decreasing subsea supply pressure, comprising:

a. providing the subsea hydraulic fluid pressure regulation system of claim 1 or claim 2;

b. connecting the fluid supply line or fluid return line to the subsea equipment;

c. starting the circulation pump at an initial pump speed;

d. after the pressure monitored by the pressure transducer of the demand-side module exceeds a predetermined pressure, opening the diverter valve such that hydraulic fluid is circulated through the circuit comprising the fluid supply line and the fluid return line; and e. increasing the pump speed of the circulation pump until the pressure monitored by the pressure transducer of the demand-side module reaches a predetermined pressure wherein the pressure monitored by the pressure transducer of the supply-side module is greater than the pressure monitored by the pressure transducer of the demand-side module and does not exceed twice the pressure monitored by the pressure transducer of the demand-side module.

22. The method of claim 21, wherein the pressure monitored by the pressure transducer of the supply-side is from 1000 psia to 20 kpsig.

23. The method of claim 21, wherein the subsea equipment is located at least 5 km from the hydraulic power unit; and wherein each of the fluid supply line and the fluid return line is at least 5 km long.

24. The method of claim 21, wherein subsea supply pressure is increased by providing the subsea hydraulic fluid pressure regulation system of claim 1 in step (a); and the fluid supply line is connected to the subsea equipment in step (b).

25. The method of claim 21, wherein subsea supply pressure is decreased by providing the subsea hydraulic fluid pressure regulation system of claim 2 in step (a); and the fluid return line is connected to the subsea equipment in step (b).

26. The method of claim 25, wherein the subsea equipment is a subsea single phase pump and wherein the hydraulic fluid is a barrier fluid to isolate a seal of the subsea single phase pump.

27. The method of claim 21, further comprising:

prior to starting the circulation pump at the initial pump speed, providing a positive displacement pump in a bypass line wherein the bypass line has a first end terminating between the subsea umbilical termination assembly and the demand-side module and a second end terminating between the demand-side module and the subsea equipment.

28. The method of claim 27, wherein an isolation valve is provided in the fluid supply line and/or the fluid return line between the demand-side module and the subsea equipment such that the positive displacement pump can be used to push or pull fluid into or from the subsea equipment.

* * * * *